US011473258B2

(12) United States Patent
Melin

(10) Patent No.: US 11,473,258 B2
(45) Date of Patent: Oct. 18, 2022

(54) PROTECTIVE BARRIER SEGMENT FOR A TEMPORARY LIQUID-DAMMING PROTECTIVE BARRIER AS WELL AS PROTECTIVE BARRIER COMPRISING SUCH A PROTECTIVE BARRIER SEGMENT

(71) Applicant: NOAQ FLOOD PROTECTION AB, Näsviken (SE)

(72) Inventor: Sigurd Melin, Näsviken (SE)

(73) Assignee: NOAQ FLOOD PROTECTION AB, Näsviken (SE)

( * ) Notice: Subject to any disclaimer, the term of this patent is extended or adjusted under 35 U.S.C. 154(b) by 0 days.

(21) Appl. No.: 17/296,109

(22) PCT Filed: Nov. 21, 2019

(86) PCT No.: PCT/SE2019/051179
§ 371 (c)(1),
(2) Date: May 21, 2021

(87) PCT Pub. No.: WO2020/106209
PCT Pub. Date: May 28, 2020

(65) Prior Publication Data

US 2022/0010514 A1 Jan. 13, 2022

(30) Foreign Application Priority Data

Nov. 22, 2018 (SE) ..... 1851447-1

(51) Int. Cl.
*E02B 3/10* (2006.01)

(52) U.S. Cl.
CPC ..... *E02B 3/106* (2013.01)

(58) Field of Classification Search
CPC ..... E02B 3/041; E02B 3/106
See application file for complete search history.

(56) References Cited

U.S. PATENT DOCUMENTS 6,450,733 B1 9/2002 Krill et al.
2008/0247825 A1* 10/2008 Bonds ..... E02B 3/102 405/107

(Continued)

FOREIGN PATENT DOCUMENTS

AU 2015261651 6/2017
DE 203 00 565 3/2003

(Continued)

OTHER PUBLICATIONS

International Search Report for PCT/SE2019/051179 dated Feb. 18, 2020, 4 pages.

(Continued)

*Primary Examiner* — Janine M Kreck
(74) *Attorney, Agent, or Firm* — Nixon & Vanderhye

(57) ABSTRACT

Disclosed is a protective barrier segment for a temporary liquid-damming protective barrier configured for separating a flooded side from a protected side by abutting against a ground surface, the protective barrier segment including a liquid-damming member having a first surface facing the flooded side and a second surface facing the protected side. The protective barrier segment is characterized in that the liquid-damming member includes an opening connecting the flooded side and the protected side and in that the protective barrier segment further includes a pump arrangement, wherein the pump arrangement is located at the opening in sealed engagement with the liquid-damming member and wherein the pump arrangement, in use, pumps liquid from the protected side to the flooded side. Also disclosed is a protective barrier including such a protective barrier segment.

20 Claims, 5 Drawing Sheets

(56) References Cited

U.S. PATENT DOCUMENTS

| | | | | |
|---|---|---|---|---|
| 2016/0273181 | A1* | 9/2016 | Smith | E02B 11/00 |
| 2022/0064887 | A1* | 3/2022 | Hodgson | E02B 3/10 |

FOREIGN PATENT DOCUMENTS

| | | | | |
|---|---|---|---|---|
| EP | 0 813 633 | | 12/1997 | |
| EP | 0 990 073 | | 4/2000 | |
| EP | 2000593 | A1 * | 12/2008 | E01F 13/022 |
| JP | 2018-53533 | | 4/2018 | |
| WO | 96/27710 | | 9/1996 | |
| WO | 98/51865 | | 11/1998 | |
| WO | 2018/15670 | A1 | 8/2018 | |

OTHER PUBLICATIONS

Written Opinion of the ISA for PCT/SE2019/051179 dated Feb. 18, 2020, 4 pages.
Extended European Search Report issued in European Patent Application No. 19887742.5 dated Jul. 25, 2022.

* cited by examiner

PROTECTIVE BARRIER SEGMENT FOR A TEMPORARY LIQUID-DAMMING PROTECTIVE BARRIER AS WELL AS PROTECTIVE BARRIER COMPRISING SUCH A PROTECTIVE BARRIER SEGMENT

This application is the U.S. national phase of International Application No. PCT/SE2019/051179 filed Nov. 21, 2019 which designated the U.S. and claims priority to SE Patent Application No. 1851447-1 filed Nov. 22, 2018, the entire contents of each of which are hereby incorporated by reference.

TECHNICAL FIELD OF THE INVENTION

The present invention relates generally to the field of temporary liquid-damming using a mobile device/arrangement, wherein the device/arrangement is reusable and is brought to different locations suffering from temporary flooding. The present invention relates specifically to the field of protective barrier segments which are used for erecting a temporary liquid-damming protective barrier, and relates specifically to a protective barrier/bank comprising at least one such protective barrier segment/section. The protective barrier segment/section comprises a liquid-damming member having a first surface facing the flooded side and a second surface facing the protected side.

BACKGROUND OF THE INVENTION

Flooding may occur in very different areas and under very different circumstances. A frequent type of flooding may hit urban areas and houses situated in the vicinity of watercourses, e.g. lakes and rivers, temporarily overflowing their banks due to extreme weather/rain. Water may then flow over the ground surface to the houses and cause various damage thereto, such as filling possible basements with water and/or partial filling of the ground floor. The water may also cause severe disruptions in traffic/train by flooding underpasses and the like. Water damage of this type are very costly to master. In other cases, liquids of other type than water, e.g. oil, fuels, chemicals and the like, may spill over on areas or surfaces as a consequence of a leakage of an unexpected type. This type of leakage may have severe negative effect on the local environment.

Regardless of the type of flooding, there is a general desire to try to prevent the liquid from reaching areas that are in a need to be protected. There are several known and conventional types of temporary protective barriers that are configured to stem the liquid from reaching the protected areas, all types having their own advantages and disadvantages.

One conventional type uses sandbags, or the like, which are manually filled and piled up in rows in order to erect the protective barrier, wherein each segment/section of the protective barrier comprises several sandbags. Another type is disclosed in patent EP0990073, and uses a plurality of L-shaped protective barrier segments that are arranged side by side and interconnected in order to form a protective barrier. Another type is disclosed in patent EP0313633, and uses one or more tube-like segments/casings that is expanded by being filled with liquid or air in order to form a protective barrier. In addition to the above-mentioned damming device, also other constructions of many different embodiments are used for flood control purposes.

However, all known temporary liquid-damming protective barriers suffer from the disadvantage that not only liquid on the flooded side is prevented from reaching the protected side, but also liquid on the protected side is prevented from reaching the flooded side. Liquid will almost always leak under the protective barrier to the protected side, and thereto the protected side will receive rain resulting in flooding of the protected side and thereto smaller brooks may have been cut off from the flooded water course by the protective barrier resulting in flooding of the protected side.

Today it is a conventional way to solve this problem by simple placing a drainage pump somewhere on the protected side and having an outlet hose extending from the pump over the protective barrier to the flooded side. However, since the ground is usually waterlogged and muddy next to the protective barrier, the drainage pump that is placed on the ground always tend to fall over leading to malfunction and there is also a high risk for clogging of the pump inlet. Thereto, since the outlet hose is not thoroughly anchored on the flooded side it will wriggle back and forth due to the recoil from the pumped liquid, bringing about a risk of damaging property and damaging the protective barrier and also a risk of injuring personnel working at the protected side.

Thereto, there is also a problem that liquid leak in under the protective barrier from the protected side, especially concerning protective barriers anchored against the ground surface by means of the liquid on the flooded side exerting a hydraulic pressure in the vertical direction on a skirt or the like element. This is especially a problem when the protective barrier is erected on a ground surface sloping downwards towards the flooded side. When liquid starts to leak under the protective barrier the pressure difference anchoring the protective barrier will be substantially reduced. This means that the area of the skirt influenced from below by the same hydraulic pressure as the top side, will lose its anchoring ability. If leakage water under hydraulic pressure is spread out under the skirt and/or the protective barrier all the way from the flooded side to the protected side, the protective barrier will gradually lose its anchoring ability and thereby its sealing ability against the ground surface, and finally be loosened from its line of defence. As soon as liquid starts to leak in under the surface of the protective barrier abutting against the ground surface, the total anchoring ability is gradually reduced, meaning that, in a state when the horizontal displacement force from the flood water exceeds the anchoring force, the protective barrier may simply float away or there may be unobstructed fluid communication under the protective barrier between the flooded side and the protected side.

OBJECT OF THE INVENTION

The present invention aims at obviating the above-mentioned disadvantages and failings of the previously known protective barriers and at providing an improved protective barrier and a protective barrier segment.

A primary object of the present invention is to provide an improved protective barrier segment of the initially defined type, wherein any liquid on the protected side of a protective barrier comprising such a protective barrier segment is safely and effectively transported/pumped to the flooded side. It is another object of the present invention to provide a protective barrier segment when used in a protective barrier increases the anchoring ability of the protective barrier, irrespective of the liquid starts to leak in under the protective barrier from the flooded side or from the protected side.

SUMMARY OF THE INVENTION

According to the invention at least the primary object is attained by means of the initially defined protective barrier segment and protective barrier having the features defined in the independent claims. Preferred embodiments of the present invention are further defined in the dependent claims.

According to the present invention, there is provided a protective barrier segment of the initially defined type, which is characterized in that the liquid-damming member comprises an opening connecting the flooded side and the protected side and in that the protective barrier segment further comprises a pump arrangement, wherein the pump arrangement is located at the opening in sealed engagement with the liquid-damming member and wherein the pump arrangement, in use, pumps liquid from the protected side to the flooded side. Thus, the present invention is based on the insight that by transporting/pumping the liquid through the protective barrier and having the pump arrangement supported by the protective barrier segment, the reliability of the transport/pumping of liquid from the protected side to the flooded side is highly increased at the same time as the anchoring ability of the protective barrier is increased, and the protective barrier is spared from being damaged by the pump arrangement. Thereto, the pumped head is minimized by not pumping over the protective barrier.

According to a preferred embodiment of the present invention, the pump arrangement comprises a submersible pump, wherein at least the drive unit of the submersible pump is located on the flooded side. Thereby, the submersible pump is provided with cooling from the liquid on the flooded side, and the submersible pump is protected from being damaged by personnel or machines working on the protected side.

According to a preferred embodiment of the present invention, the protective barrier segment comprises means for supporting the submersible pump (14) in a fixed orientation, preferably up-right orientation. Thereby the submersible pump is prevented from falling over.

According to a preferred embodiment of the present invention, the pump arrangement comprises an inlet screen for pre-filtering the pumped liquid. Thereby leafs and debris is prevented from reaching and clogging the submersible pump and the opening.

Further advantages with and features of the invention will be apparent from the other dependent claims as well as from the following detailed description of preferred embodiments.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF PREFERRED EMBODIMENTS OF THE INVENTION

Figure 1A:
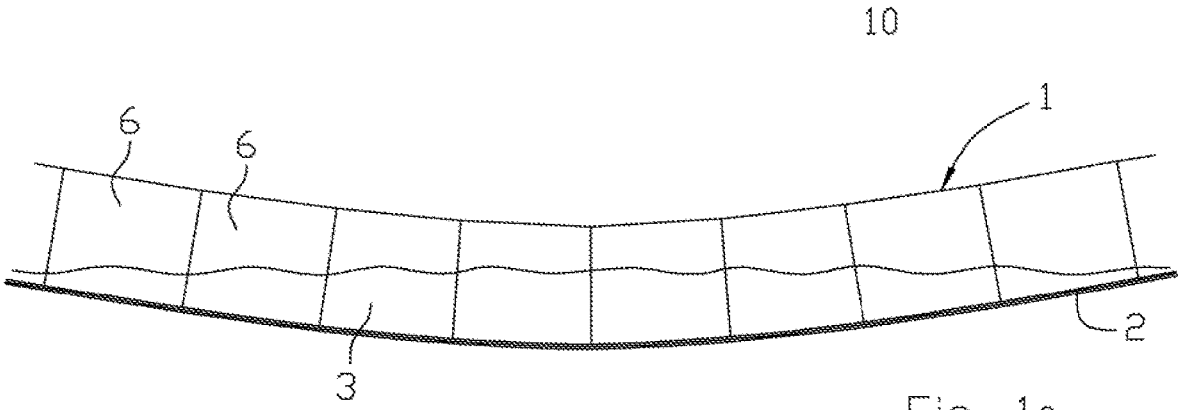
FIG. 1*a* is a side view of schematic protective barrier comprising a plurality of short protective barrier segments.
Figure 1B:
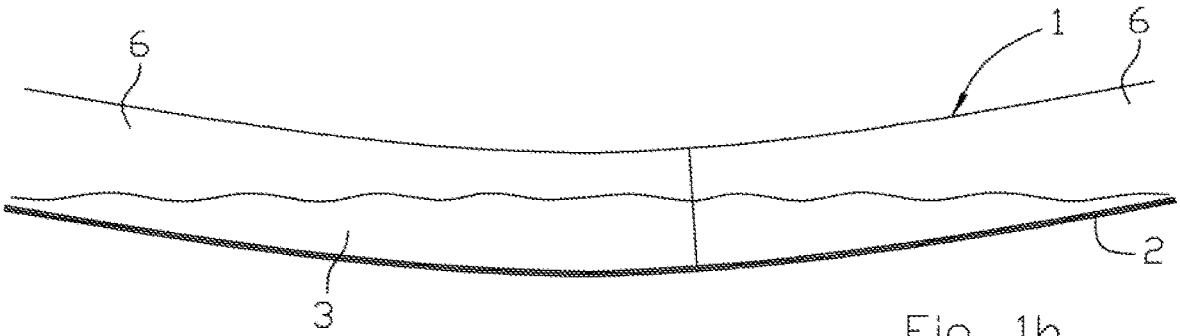
FIG. 1*b* is a side view of a schematic protective barrier comprising a few oblong protective barrier segments.
Figure 1C:
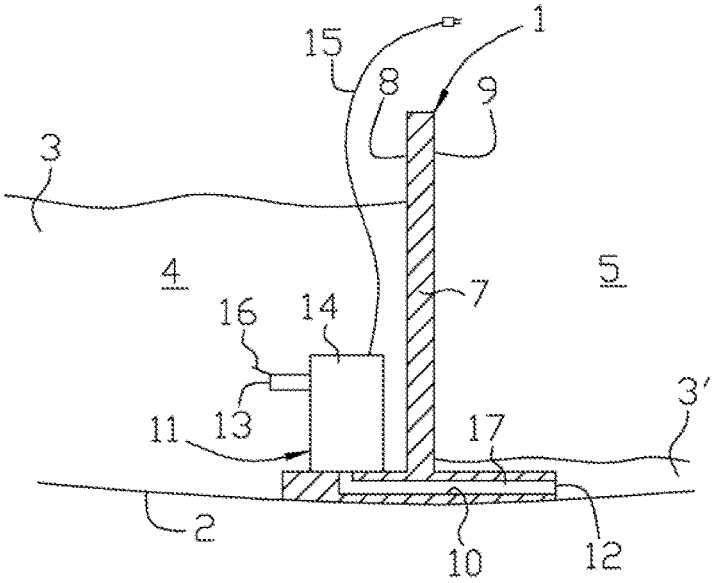
FIG. 1*c* is a cross sectional side view of schematic protective barrier segment.

Reference is initially made to the schematic FIGS. 1*a*-1*c*. The present invention relates in general to a mobile and temporary liquid-damming device/arrangement, also known as protective barrier or protective bank, generally designated 1. The protective barrier 1 is configured to be placed on a ground surface 2, i.e. abutting directly against the soil/ground or against a similar man-made surface with the purpose of damming liquid 3, such as water, from reaching a protected object/area, such as a house, a road, a tunnel, etc. FIG. 1*c* disclose a cross section of a schematic protective barrier 1, and irrespective the actual design of the cross section of the protective barrier 1 they all have in common that they separates a flooded/wet side 4, to the left of the protective barrier 1, from a protected/dry side 5, to the right of the protective barrier 1.

The protective barrier 1 comprises at least one protective barrier segment 6, and depending on the type of protective barrier 1 each protective barrier segment 6 has different extensions.

Each protective barrier segment or section 6 has a width, i.e. maximum extension seen from the flooded side 4 to the protected side 5, a length, i.e. maximum extension along the length of the protective barrier 1, and a height, i.e. maximum extension from the ground surface upwards. It shall be pointed out that the width of the protective barrier segment 6 can be larger than, equal to or less than the length of the protective barrier segment 6. Thus, a protective barrier 1 may be constituted by one or a few protective barrier segments 6 that are oblong, as seen in FIG. 1*b*, or may be constituted by a plurality of protective barrier segments 6 that are short, as seen in FIG. 1*a*. When the protective barrier 1 comprises more than one protective barrier segment 6, the segments are interconnected in a watertight way. It shall also be pointed out that a specific protective barrier 1 may comprise protective barrier segments of different types/shape.

It shall be pointed out that in this document different types/shapes of protective barriers are disclosed using different known basic technologies for damming liquid, however, it shall be pointed out that the present invention is not limited to the disclosed exemplary types/shapes and that the list of disclosed basic technologies is not considered to be exhaustive.

In common for all protective barriers 1 is that the protective barrier segment 6 comprises a liquid-damming member 7, i.e. a member/element/structure configured to stem liquid on the flooded side 4 and to prevent the liquid from reaching the protected side 5. All liquid-damming members 7 has a first surface 8 facing the flooded side 4 and a second surface 9 facing the protected side 5. The liquid-damming member 7 can be hard, flexible/soft, or combination thereof, and can be self-supporting or supported by other components.

According to one known branch of technology the liquid-damming member 7 comprises or is constituted by an impermeable component, such as a suitable fabric, plastic, rubber, metal, or the like or combined material, in order to prevent the liquid on the flooded side 4 from reaching the protected side 5. According to another known branch of technology the liquid-damming member 7 has the function of preventing the liquid on the flooded side 4 from reaching the protected side 5 by joint action of the individual components making up the protective barrier segment 6, i.e. stacked/piled up sandbags, a piled up ridge of soil/sand, etc.

All such protective barriers 1 serves its purpose very well, i.e. prevents liquid on the flooded side 4 from reaching the protected side 5, but at the same time the protective barrier 1 prevents liquid 3' on the protected side 5 from reaching the flooded side 4. The liquid on the protected side 5 may come from rain, creeks cut-off by the protective barrier, etc.

The present invention will be explained with reference to FIG. 1*c* disclosing a schematic protective barrier segment 6. It is essential for the inventive protective barrier segment 6 that the liquid-damming member 7 comprises an opening 10 connecting the flooded side 4 and the protected side 5, i.e. a through hole. Thereto it is essential that the protective barrier segment 6 further comprises a pump arrangement 11, wherein the pump arrangement 11 is located at said opening 10 in sealed engagement with the liquid-damming member 7. An inlet opening 12 of the pump arrangement 11 is located at the protected side 5, i.e. in fluid communication with the protected side 5, and an outlet opening 13 of the pump arrangement 11 is located at the flooded side 4, i.e. in fluid communication with the flooded side 4. When the pump arrangement 11 is in operation, i.e. in use, it pumps liquid from the protected side 5 to the flooded side 4 through the opening 10 of the liquid-damming member 7. The pump arrangement 11 also prevents the liquid on the flooded side 4 from reaching the protected side 5 via the opening 10 in the liquid-damming member 7, by being in sealed engagement with the liquid-damming member 7 at the opening 10. The opening 10 is preferably located at the lower half of the protective barrier segment 6.

It shall be realized that the pump arrangement 11 and the liquid-damming member 7 that are configured to be used together are preferably transported separately to the location of the protective area and joined together at site. They can also be provided from different locations.

The inventive protective barrier segment 6 comprises at least one opening 10 and one pump arrangement 11. An inventive protective barrier 1 comprises at least one such protective barrier segment 6.

The sealing engagement between the pump arrangement 11 and the liquid-damming member 7 at the opening 10 may be realized by means of a separate sealing member arranged between the liquid-damming member 7 and the pump arrangement 11 and/or may be realized due to close fit/contact between the liquid-damming member 7 and the pump arrangement 11.

The pump arrangement 11 is at least constituted by a submersible pump 14, and the submersible pump 14 is configured to be partly or wholly submerged in the liquid. The submersible pump 14 may be located on the protected side 5, the flooded side 4 or a combination thereof. According to a preferred embodiment at least the drive unit of the submersible pump 14 is located on the flooded side 4. The drive unit of the submersible pump comprises an electric motor located in a watertight pump housing. The power supply to the electric motor is made via an electric cable 15 extending through the pump housing via a watertight lead through. A drive shaft extends from the electric motor and an impeller is connected to the free end of the drive shaft, wherein the impeller during operation is driven in rotation by the electric motor via the drive shaft to pump liquid from the inlet opening 12 to the outlet opening 13.

Thus, it is conceivable that part of the submersible pump 14 is located on the flooded side 4 and part of the submersible pump 14 is located on the protected side 5, wherein the watertight pump housing of the submersible pump 14 is in sealed engagement with the liquid-damming member 7 in the opening 10. According to another embodiment the entire submersible pump 14 is located on the flooded side 4. The submersible pump 14 is preferably located in the opening 10 and supported by the opening 10.

By having the submersible pump 14 partly or wholly located on the flooded side 4, the risk that the submersible pump 14 is damaged by people or machines working on the protected side 5 is totally eliminated. Thereto, the submersible pump 14 is cooled off effectively by the liquid 3 on the flooded side 4 and prevented from overheating also when no or little liquid 3' is pumped and the submersible pump 14 is still operating, also known as snoring.

According to a preferred embodiment, the pump arrangement 11 comprises a non-return valve 16 preventing the liquid on the flooded side 4 from flowing to the protected side 5 via the pump arrangement 11, when the pump arrangement 11 is inactive, i.e. the impeller of the submersible pump 14 is not rotating. This is advantageous if the submersible pump 14 loses its power or if the submersible pump 14 is configured to be active only when there is liquid 3' present on the protected side 5. Thus, the submersible pump 14 can be operated in ON/OFF mode by means of a level sensor or the like. The non-return valve 16 is preferably located at the outlet opening 13, and can be constituted by a hinged plate or the like. The non-return valve 16 may be biased towards the closed position. Thereto the opening 10 of the liquid-damming member 7 may be provided with a lid/cover that will dose the opening 10 in the event the submersible pump 14 or pump arrangement 11 need to be replaced, serviced, etc.

According to some embodiments the pump arrangement 11 comprises an inlet pipe/conduit 17 extending from the submersible pump 14 to the protected side 5 through the opening 10, wherein the inlet pipe 17 is in sealed engagement with the liquid-damming member 7.

The protective barrier segment 6 preferably comprises means for supporting/bracing the submersible pump 14 in a fixed orientation, preferably upright orientation in relation to the ground surface. The means for supporting/bracing prevents the submersible pump 14 from falling over. The means for supporting/bracing or fixating the submersible pump 14 may be constituted by the liquid-damming member 7 or by a separate element that is freestanding from the liquid-damming member 7 or by a separate element arranged in the opening 10.

The protective barrier segment 6 or the pump arrangement 11 may comprise an inlet screen or net at the inlet opening 12 for pre-filtering of the pumped liquid 3', i.e. in order to prevent leafs and debris from reaching and clogging the submersible pump 14.

Different realizations of the present invention will now be described and disclosed with reference to FIGS. 2-5. Corresponding elements in the different realizations are given the same name and reference number, and elements that are the like in different realizations is only described once.

Figure 2:
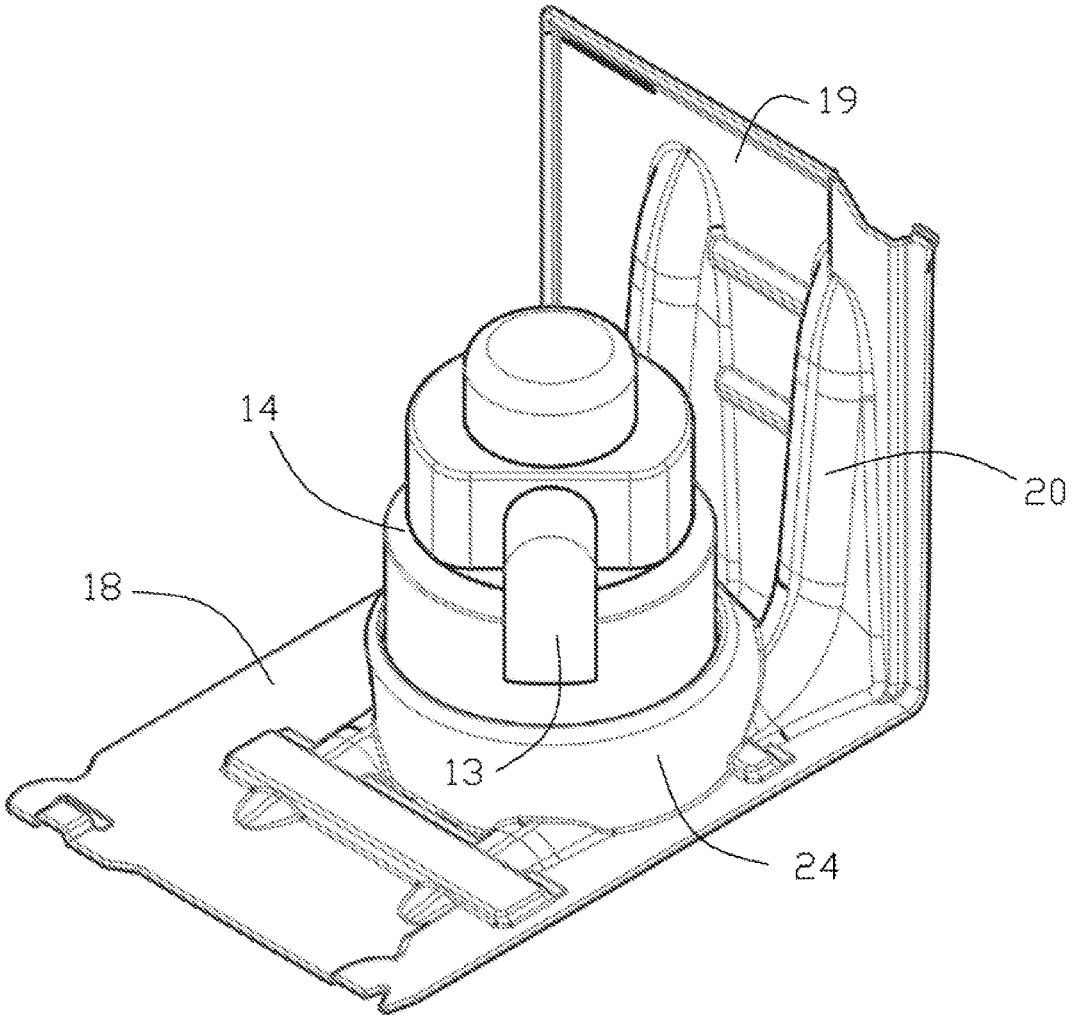
FIG. 2 is a perspective view from above of an example of an inventive protective barrier segment.
Figure 3:
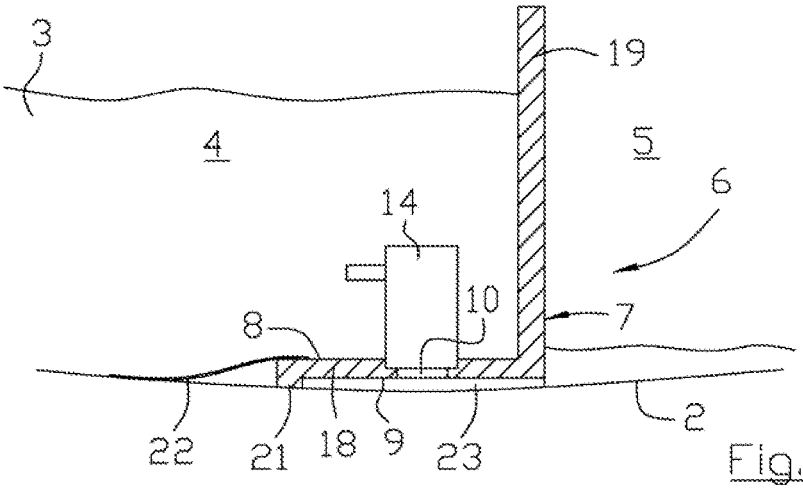
FIG. 3 is a cross sectional side view of a schematic L-shaped protective barrier segment.

Reference is now made to FIGS. 2 and 3, disclosing a preferred embodiment of the present invention. The liquid-damming member 7 of the protective barrier segment 6 is generally L-shaped, i.e. self-supported, wherein the "foot" of the L-shape is turned towards the flooded side 4. The liquid-damming member 7 comprises a bottom portion/board 18, i.e. the "foot" of the L-shape, configured to be placed abutting the ground surface 2 and has the purpose of anchoring the liquid-damming segment 6 by being urged against the ground surface 2 by the liquid 3, and the liquid-damming member 7 comprises further a wall/board 19 connected to the bottom portion 18 in an upright configuration and having the purpose of damming the liquid 3, i.e. retaining the liquid on the flooded side 4. It shall be realized that the angle between the bottom portion 18 and the wall 19 must not be perpendicular.

The wall 19 can be fixedly or releasably connected to the bottom portion 18, and it shall be pointed out that the interface/limit between the wall 19 and the bottom portion 18 may be indistinct and the interface between them may be constituted by an arc-shaped transition instead of a sharp edge. The wall 19 is preferably located at the end of the bottom portion 18 closest to the protected side 5, i.e. the proximal end of the bottom portion 18. The liquid-damming member 7 may also comprise reinforcements 20 or the like to keep the liquid-damming member 7 stable in shape during use.

In the disclosed embodiment the liquid-damming member 7 is made of plastic and moulded in one piece. According to an alternative embodiment, the liquid-damming member 7 may comprise a L-shaped support/framework construction covered by an impermeable fabric/tarpaulin at the first surface 8.

According to a preferred embodiment, the first surface 8 of the bottom portion 18 of the liquid-damming member 7 is facing upwards and the second surface 9 of the bottom portion 18 of the liquid-damming member 7 is facing downwards, i.e. the protected side 5 is also located under the bottom portion 18.

The bottom portion 18 of the liquid-damming member 7 comprises a longitudinal contact zone 21, i.e. along the length of the protective barrier segment 6, at least at the distal end region of the bottom portion 18. The contact zone 21 is configured to abut against the ground surface in order to separate the flooded side 4 and the protected side 5. The protective barrier segment 6 may alternatively/supplementary comprise a skirt 22 or the like flexible strip of material/fabric arranged at the distal end of the bottom portion 18 and bridging over from the ground surface 2 to the first surface 8 of the bottom portion 18, in order to enhance the ability to prevent liquid from seeping under the bottom portion 18 from the flooded side 4. The skirt 22 may extend along several protective barrier segments, or each protective barrier segment may comprise a separate skirt 22 overlapping each other. Thus, the skirt 22 may constitute the contact zone of the bottom portion 18. The skirt 22 may be auxiliary fixated against the ground surface 2 by nails/pins, by separate weights, or the like.

The protective barrier segment 6 may also comprise drainage means 23 generating passages extending from the protected side 5 to underneath the bottom portion 18 in order to drain away any liquid leaking under the bottom portion 18 from the flooded side 4 in order to keep the area below the bottom portion 18 at or close to atmospheric pressure, when any liquid 3' on the protected side 5 has been removed. The draining means 23 preferably extends all the way from the contact zone 21 to underneath the wall 19, however it is conceivable to limit the extension of the draining means 23 to only a part of the width of the protective barrier segment 6 and/or to only a part of the length of the protective barrier segment 6. In practice, the draining means 23 may be achieved in several different ways. The drainage means may, for instance, be realized by means of a profiled bottom portion 18 or spacing elements which are either permanently attached to the bottom portion 18 or loosely applied between the bottom portion 18 and the ground surface 2. In this context it shall also be mentioned that the draining means 23 may be equally thick or wedge-shaped from a maximum height at the wall 19 to a minimal height at the contact zone 21. The protective barrier segment 6, may comprise an inlet screen or net located at the wall 19 to prevent leafs and debris to enter the drainage means 23 and to accumulate underneath the bottom portion 18.

In the disclosed embodiment the opening 10 is located in the bottom portion 18 of the liquid-damming member 7 and the submersible pump 14 is located at the opening 10, such that any liquid present under the protective barrier segment 6 will be transported to the flooded side 4 when the submersible pump 14 is operating, provided that the liquid 3' on the protected side 5 is enough to prime the submersible pump 14. According to an alternative embodiment the opening 10 is provided at the lower end of the wall 19, and such realization preferably comprises an inlet pipe 17 extending through the opening 10 and downwards to the ground surface 2 in order to have an optimized distance between the inlet opening 12 and the ground surface 2.

According to the realization disclosed in FIG. 2, the bottom portion 18 of the liquid-damming member 7 comprises a seat 24 for supporting/bracing the submersible pump 14 in a fixed orientation. The seat 24 is constituted by a collar surrounding the opening 10, i.e. the walls of the opening 10, wherein the pump 14 is located inside the collar. The seat 24 and/or the pump 14 comprise means to fixate the position of the pump 14 in relation to the ground surface 2. The pump 14 may rest on a flange in the opening 10 or the pump 14 may comprise a flange abutting the upper rim of the seat/collar 24. The inlet opening 12 of the pump arrangement 11, i.e. the inlet opening of the pump 14, may be located above the second surface 9 of the bottom portion 18, i.e. within the seat/collar 24, or located below the second surface 9 of the bottom portion 18, i.e. on the protected side 5. Preferably the submersible pump 14 may be positioned at different heights in relation to the bottom portion 18 in order to adjust the distance between the inlet opening of the submersible pump 14 and the ground surface 2. A greater distance provides an increased flow rate and a lesser distance provides less remaining liquid on the protected side 5. The submersible pump 14 may be bolted to the bottom portion 18. The inlet of the submersible pump 14 is the same as the inlet opening 12 of the pump arrangement 11, in this embodiment.

The protective barrier segment 6 may comprise a separate sealing member arranged between the pump housing and the liquid-damming member 7 and/or the pump housing may be in direct/sealing contact with the liquid-damming member 7.

According to an alternative realization, the pump arrangement 11 may comprise a bucket-like insert located in the opening 10. The insert is in sealed engagement with the liquid-damming member 7, wherein at least the lower area of such insert comprises one or more holes and wherein the submersible pump 14 is positioned in the insert and is supported/braced direct or indirect by the insert. The submersible pump 14 is in sealed engagement with the insert. The sealing engagement between the pump housing and the bottom portion 18, or between the pump housing and the insert, may be realized by means of a flexible gaiter or fabric adapted to fit different sized submersible pumps 14.

Figure 4A:
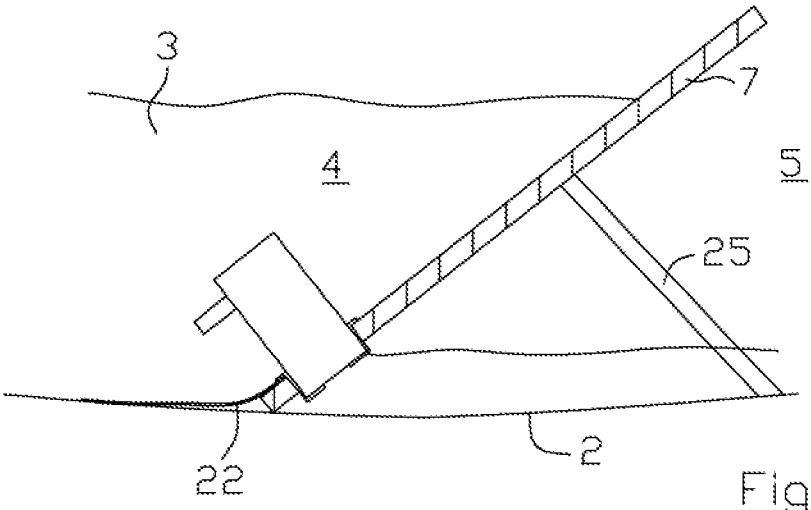
FIGS. 4*a*-4*b* are cross sectional side views of schematic inclined protective barrier segments.
Figure 4B:
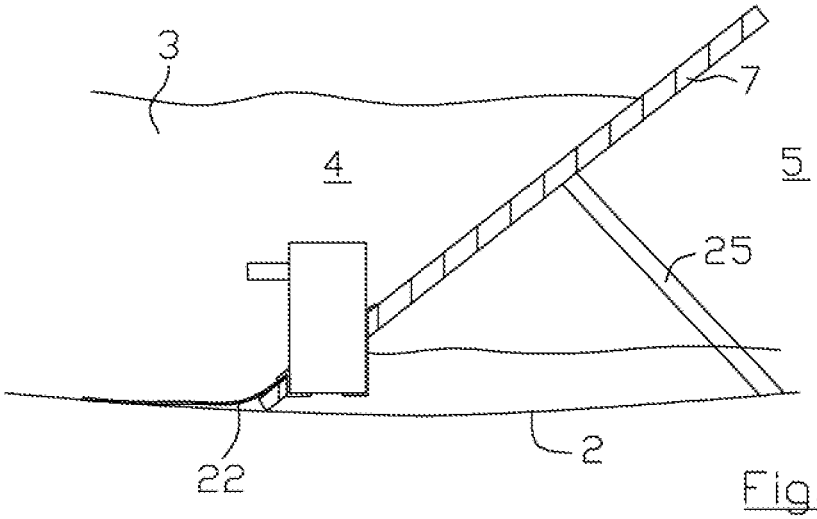

Reference is now made to FIGS. 4*a* and 4*b* disclosing an inclined liquid-damming member 7 comprising a board, a loading pallet, or the like, that is supported by stays 25 on the protected side 5. The protective barrier segment 6 comprises a skirt 22 bridging over from the ground surface 2 to the board. The skirt 22 may constitute the entire first surface 8 of the liquid-damming member 7. Since the board is inclined away from the flooded side 4, the liquid 3 on the flooded side 4 will anchor the liquid-damming member 7 by applying a downward force at the same time as the liquid is prevented from reaching the protected side 5. The opening 10 is located at the lower end of the liquid-damming member 7. The configuration of the opening 10 and the cooperation between the submersible pump 14, the opening 10, an insert, seal engagement, collar, etc. correspond to the realization according to FIGS. 2 and 3, and is not described again, thus the board in FIG. 4 corresponds in all essentials to the bottom portion 18 in FIGS. 2 and 3. It shall be pointed out that the submersible pump 14 may be oriented at an angle in relation to the board, i.e. in a vertical direction as disclosed in FIG. 4*b*, in order to minimize the distance between the inlet of the submersible pump 14 and the ground surface 2.

Figure 5:
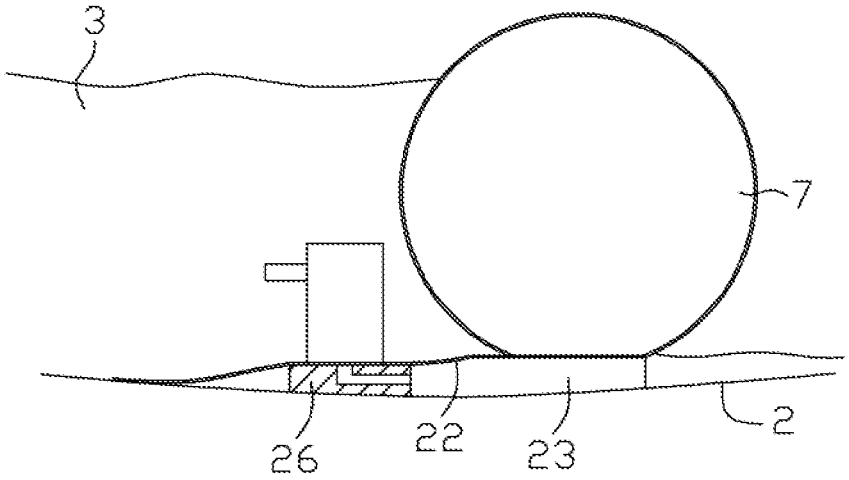
FIGS. 5-6 are cross sectional side views of schematic tube-shaped protective barrier segments.
Figure 6:
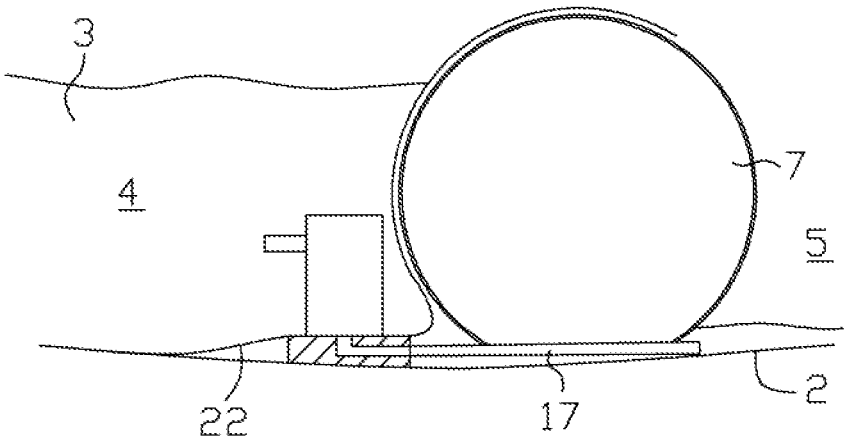

Reference is now made to FIGS. 5 and 6 disclosing a tube-like casing to be used as liquid-damming member 7, wherein the tube-like casing is filled/erected with water or with air. The tube-like casing corresponds to the wall 19 of the realization according to FIGS. 2 and 3. The liquid-damming member 7 of the protective barrier segment 6 also comprises a skirt 22 connected to the tube-like casing, wherein the skirt 22 prevents the liquid on the flooded side 4 to leak under the tube-like casing, at the same time as the skirt 22 is anchored to the ground surface 2 by the liquid 3 in order to prevent the tube-like casing from floating away. The skirt 22 correspond to the bottom portion 18 of the realization according to FIGS. 2 and 3. The skirt 22 may be fixed connected to the tube-like casing as disclosed in FIG. 5 or detachable connected to the tube-like casing as illustrated in FIG. 6, for instance by means of zippers. The protective barrier segment 6 may comprise drainage means 23 located under the tube-like casing as already described together with the realization according to FIGS. 2 and 3. The opening 10 is arranged in the skirt 22, and the protective barrier segment 6 comprises supporting/bracing means 26 located under the skirt 22 such that the submersible pump 14 is arranged at the opening 10 and supported by the supporting means 26. Thereby the submersible pump 14 is prevented from falling over. The sealing engagement between the pump arrangement 11 and the skirt 22 of the liquid-damming member 7 is realized in corresponding ways as the previously described realizations of the invention, i.e. by separate seal elements or by close contact between the pump arrangement 11 and the liquid-damming member 7, i.e. the skirt 22.

The pump arrangement 11 may comprise an inlet pipe 17 extending from the protected side 5 to the supporting means 26, as illustrated in FIG. 6, such that liquid accumulating on the protected side 5 will reach the submersible pump 14, alternatively the drainage means 23 will extend all the way from the protected side 5 to the supporting means 26, as disclosed in FIG. 5, such that liquid accumulating on the protected side 5 will reach the submersible pump 14.

According to an alternative realization the protective barrier segment 6 is constituted by a connector screen or joint cover configured to interconnect two protective barrier segments 6 in order to provide a continuous protective barrier 1, i.e. intended to cover the joint. The joint cover is attached to both the skirt 22 and the tube-like casing of both protective barrier segments 6, for instance using zippers, such that the joint cover comprises a bottom portion and an upright portion. The opening 10 is located in the bottom portion, and the protective barrier segment 6 comprises supporting means 26 located below the bottom portion such that the submersible pump 14 is arranged at the opening 10 and supported by the fixture/supporting means 26, corresponding to the realization disclosed in FIG. 6. The joint cover realization may also be used together with the inclined liquid-damming member 7 according to FIGS. 4*a* and 4*b*. The joint cover is preferably made by a fabric, or the like.

Figure 7:
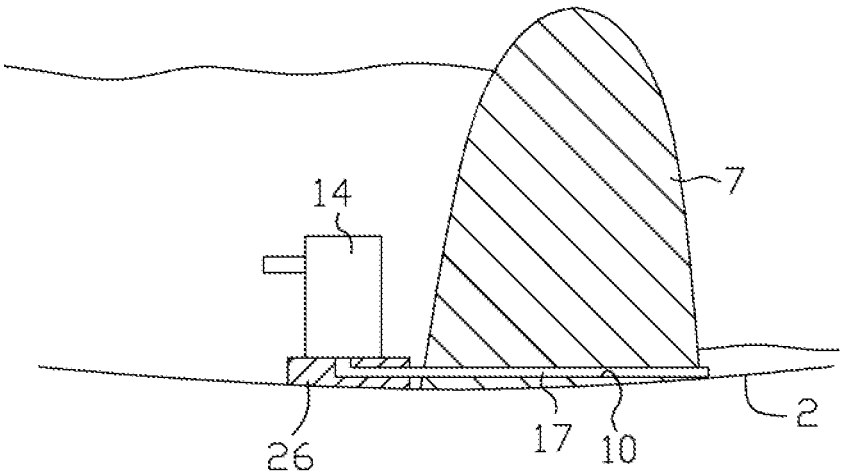
FIGS. 7-8 are cross sectional side views of schematic stacked/piled up protective barrier segments.
Figure 8:
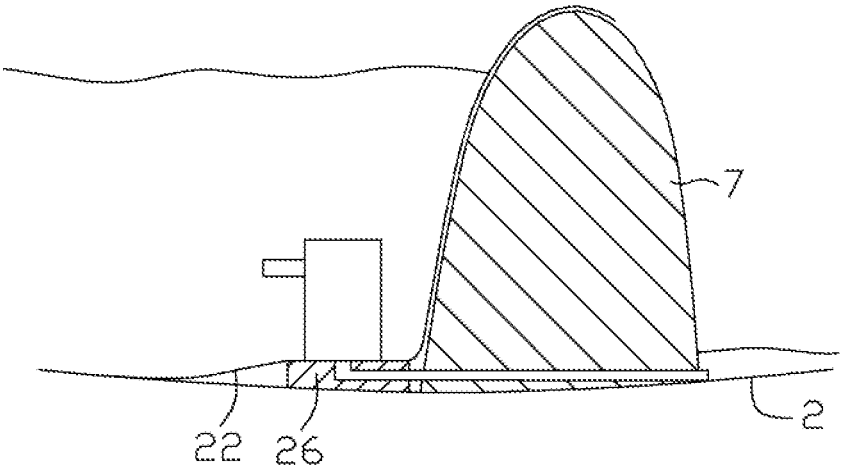

Reference is now made to FIGS. 7 and 8 disclosing a protective barrier 1 comprising stacked/piled up material, such as prefilled sandbags, a ridge of soil/sand, or the like, to be used as liquid-damming member 7. It shall be pointed out that the protective barrier in this embodiment is constituted by one protective barrier segment.

In FIG. 7 the inlet pipe 17 of the pump arrangement 11 is arranged at the bottom of the liquid-damming member 7 creating an opening 10 in the liquid-damming member 7 from the protected side 5 to the flooded side 4. The liquid-damming member 7 is in sealed engagement with the inlet pipe 17 of the pump arrangement 11. The submersible pump 14 is supported by the supporting/bracing means 26 and is connected to the inlet pipe 17.

In FIG. 8 is disclosed a realization that is a combination of the realizations disclosed in FIGS. 6 and 7, i.e. the liquid-damming member 7 disclosed in FIG. 7 comprises a skirt 22, or joint cover, that constitutes the first surface 8 of the liquid-damming member 7 and bridges over from the ground surface 2 to the pile up material. The skirt 22 comprises an opening 10, and the protective barrier segment 6 comprises supporting means 26 located below the skirt 22 such that the submersible pump 14 is arranged at the opening 10 and supported by the fixture/supporting means 26, corresponding to the realization disclosed in FIG. 6.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and the equivalents thereof. Thus, the equipment may be modified in all kinds of ways within the scope of the appended claims.

It shall also be pointed out that all information about/concerning terms such as above, under, upper, lower, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

Throughout this specification and the claims which follows, unless the context requires otherwise, the word "comprise", and variations such as "comprises" or "comprising", will be understood to imply the inclusion of a stated integer or steps or group of integers or steps but not the exclusion of any other integer or step or group of integers or steps.

The invention claimed is:

1. A protective barrier segment (6) for a temporary liquid-damming protective barrier (1) configured for separating a flooded side (4) from a protected side (5) by abutting against a ground surface, the protective barrier segment (6) comprising a liquid-damming member (7) having a first surface (8) facing the flooded side (4) and a second surface (9) facing the protected side (5), wherein the liquid-damming member (7) comprises an opening (10) connecting the flooded side (4) and the protected side (5) and wherein the protective barrier segment (6) further comprises a pump arrangement (11), wherein the pump arrangement (11) is located at the opening (10) in sealed engagement with the liquid-damming member (7) and wherein the pump arrangement (11), in use, pumps liquid from the protected side (5) to the flooded side (4).

2. The protective barrier segment (6) according to claim 1, wherein the pump arrangement (11) comprises a submersible pump (14).

3. The protective barrier segment (6) according to claim 2, wherein the submersible pump (14) comprises a drive unit, and the drive unit of the submersible pump (14) is located on the flooded side (4).

4. The protective barrier segment (6) according to claim 3, wherein the protective barrier segment (6) further comprises means for supporting the submersible pump (14) in a fixed orientation.

5. The protective barrier segment (6) according to claim 3, wherein the pump arrangement (11) comprises an inlet pipe (17) extending from the submersible pump (14) to the protected side (5).

6. The protective barrier segment (6) according to claim 3, wherein the pump arrangement (11) comprises a non-return valve (16) preventing liquid from flowing from the flooded side (4) to the protected side (5) when the pump arrangement (11) is inactive.

7. The protective barrier segment (6) according to claim 2, wherein the protective barrier segment (6) further comprises means for supporting the submersible pump (14) in a fixed orientation.

8. The protective barrier segment of claim 7, wherein the fixed orientation is upright.

9. The protective barrier segment (6) according to claim 7, wherein the pump arrangement (11) comprises an inlet pipe (17) extending from the submersible pump (14) to the protected side (5).

10. The protective barrier segment (6) according to claim 2, wherein the pump arrangement (11) comprises an inlet pipe (17) extending from the submersible pump (14) to the protected side (5).

11. The protective barrier segment (6) according to claim 2, wherein the submersible pump (14) comprises a pump housing, and the pump housing of the submersible pump (14) is located in the opening (10) in sealed engagement with the liquid-damming member (7).

12. The protective barrier segment (6) according to claim 11, wherein the protective barrier segment (6) comprises a sealing member arranged between the liquid-damming member (7) and the pump arrangement (11).

13. The protective barrier segment (6) according to claim 2, wherein the pump arrangement (11) comprises a non-return valve (16) preventing liquid from flowing from the flooded side (4) to the protected side (5) when the pump arrangement (11) is inactive.

14. The protective barrier segment (6) according to claim 1, wherein the pump arrangement (11) comprises a non-return valve (16) preventing liquid from flowing from the flooded side (4) to the protected side (5) when the pump arrangement (11) is inactive.

15. The protective barrier segment (6) according to claim 1, wherein the protective barrier segment (6) comprises an inlet screen for pre-filtering the pumped liquid.

16. The protective barrier segment (6) according to claim 1, wherein the liquid-damming member (7) comprises a bottom portion (18), the first surface (8) of the bottom portion (18) facing upwards and the second surface (9) of the bottom portion (18) facing downwards, and wherein the bottom portion (18) comprises a transverse contact zone (21), at least at the distal end region of the bottom portion (18), the contact zone (21) being configured to abut against the ground surface in order to separate the flooded side (4) and the protected side (5).

17. The protective barrier segment (6) according to claim 16, wherein the liquid-damming member (7) comprises a wall (19) connected to the bottom portion (18) at a distance from the distal end region, wherein the wall (19) is configured to retain the liquid on the flooded side (4).

18. The protective barrier segment (6) according to claim 17, wherein the opening (10) is located in the bottom portion (18) intermediate the distal end region and the wall (19).

19. The protective barrier segment (6) according to claim 16, wherein the protective barrier segment (6) further comprises drainage means (23) generating passages extending from the protected side (5) to underneath the protective barrier segment (6), in order to drain away any liquid leaking under the bottom portion (18).

20. A protective barrier (1) for temporary liquid-damming, wherein the protective barrier (1) comprises at least one protective barrier segment (6) according to claim 1.

* * * * *